US005114761A

United States Patent [19]

Doherty

[11] Patent Number: 5,114,761

[45] Date of Patent: May 19, 1992

[54] DECORATIVE DRAWSTRING BOW FORMING RIBBON ASSEMBLY

[75] Inventor: Henry T. Doherty, Franklin Lakes, N.J.

[73] Assignee: Berwick Industries Inc., Pa.

[21] Appl. No.: 703,658

[22] Filed: May 21, 1991

[51] Int. Cl.[5] ..... D04D 7/10

[52] U.S. Cl. ..... 428/4; 156/70; 223/46; 428/101

[58] Field of Search ..... 428/4, 5, 24, 101; 223/46; 156/70

[56] References Cited

U.S. PATENT DOCUMENTS

| | | | |
|---|---|---|---|
| 3,637,455 | 1/1972 | Pearson et al. | 428/4 |
| 3,954,212 | 5/1976 | Bolis | 223/46 |
| 4,515,837 | 5/1985 | Cheng | 428/4 |
| 4,585,676 | 4/1986 | DeSmet et al. | 428/5 |
| 4,656,064 | 4/1987 | Cheng | 428/4 |
| 4,822,648 | 4/1989 | Cheng | 428/4 |
| 5,026,578 | 6/1991 | Iname | 428/4 |

*Primary Examiner*—Henry F. Epstein

*Attorney, Agent, or Firm*—Sughrue, Mion, Zinn, Macpeak & Seas

[57] ABSTRACT

A longitudinally extending decorative flexible ribbon having opposite side edges and a central longitudinal axis is provided with a plurality of cutouts within opposite side edges of the ribbon at longitudinally spaced positions forming narrow necks joining uncut portions of the ribbon, intermediate of the cutouts. A longitudinally extending drawstring fixed at one end to an end of the longitudinally extending decorative flexible ribbon extends along the ribbon and is positioned in alignment with said neck at each longitudinally spaced position. A retainer encircles each neck and the drawstring at each longitudinally spaced position such that the drawstring runs freely through the retainers. The cutouts extend laterally from said opposed side edges beyond the longitudinal axis of the ribbon to create an asymmetrical assembly with the necks at adjacent longitudinally spaced positions being to opposite sides of the longitudinal axis ensuring fanning out of loops upon pulling on the drawstring and causing the retainers to move into a closely packed stack array to create a decorative bow.

14 Claims, 1 Drawing Sheet

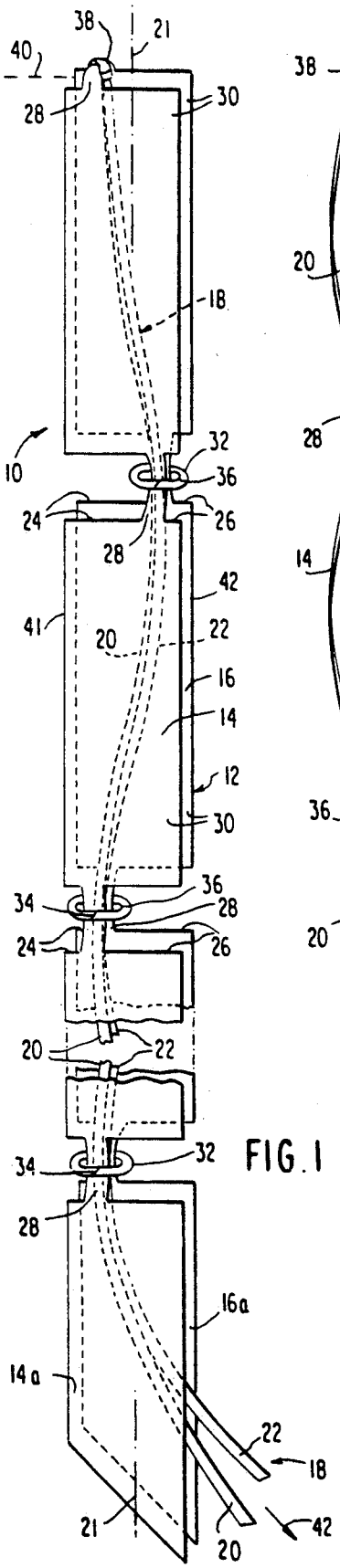
FIG. 1
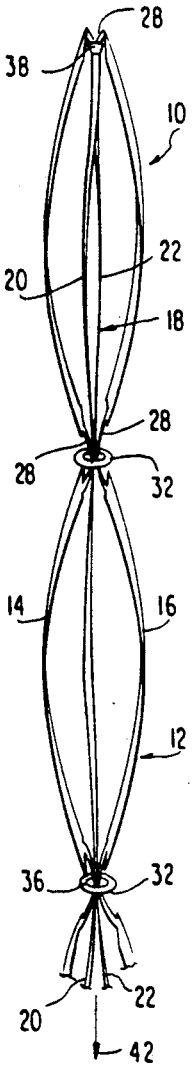
FIG. 2
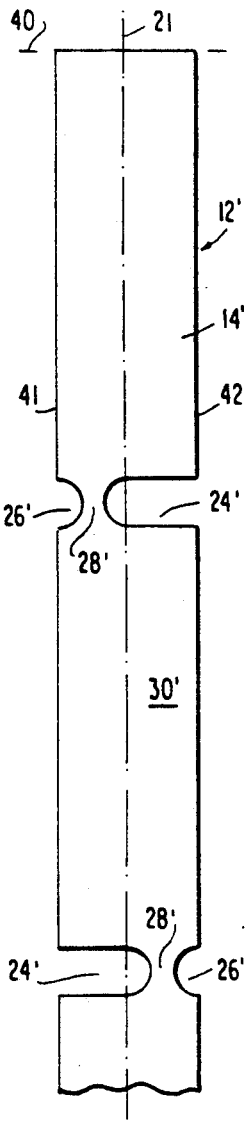
FIG. 3
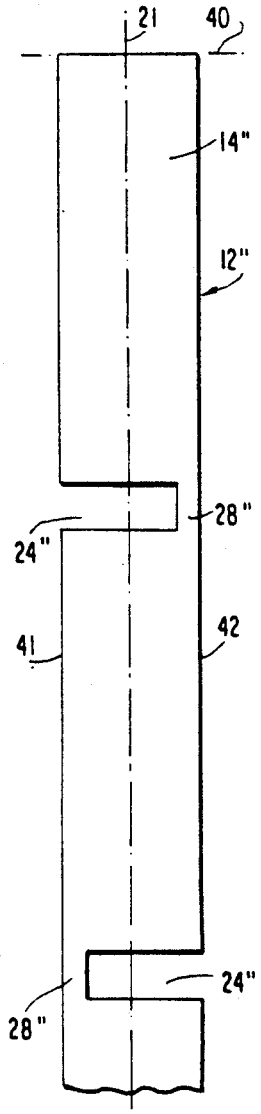
FIG. 4
FIG. 5
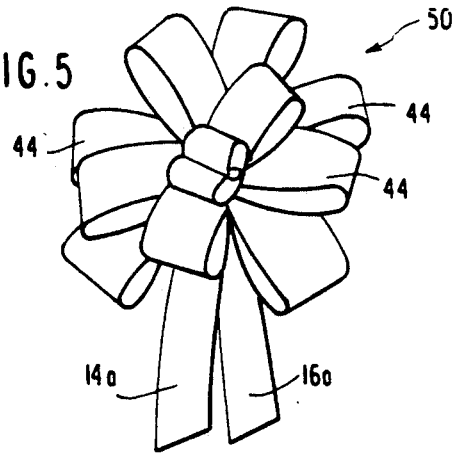

DECORATIVE DRAWSTRING BOW FORMING RIBBON ASSEMBLY

FIELD OF THE INVENTION

This invention relates to a decorative drawstring bow forming ribbon assembly and more particularly to a simplified ribbon assembly which ensures fanning out of the loops forming the bow upon tensioning of the drawstring.

Decorative bows in the past have been made by hand however, within recent years, such decorative bows have been formed as a ribbon assembly including a drawstring such that by pulling on the drawstring, the assembly which is preformed into a flat bow form is drawn into "floral", "pom-pom" or other type of bows.

As such, the loops of the bow are not yet formed in the manufacturer of the ribbon assembly, thus, the ribbon assembly may be easily shipped, and stored. A floral bow is one in which the loops are generally unequal while a pom-pom bow has generally equal loops thereby creating a relatively uniform or highly symmetrical pattern.

In the development of a bow forming ribbon assembly, such assemblies, in part, have tended to consist of a longitudinal-extending decorative flexible ribbon which may constitute a singular longitudinal strip, or preferably one simply folded in half to provide ribbon members or sections which are in face-to-face relation with a bow string or drawstring situated between the ribbon members. Further, the drawstring may itself be folded over to form two drawstring members and with each drawstring member running freely the length of the ribbon assembly.

The drawstring is held to the single ribbon or sandwiched between dual ribbon members by retainers which permit the drawstring to run free over the length of the assembly.

The present invention is directed to an improvement within such structures as exemplified by U.S. Pat. No. 3,637,455 issued Jan. 25, 1972 to Walter C. Pearson et al, entitled Prefabricated Bow Forms; U.S. Pat. No. 3,954,212 issued May 4, 1976 to Ernesto Bolis, entitled Method for Making Ribbons Curlable in a Cockade Fashion and; U.S. Pat. No. 4,585,676 issued Apr. 29, 1986 to Vicki M. DeSmet, entitled Decorative Pull-String Bows.

All of these patents are directed to a preformed ribbon assembly in which a pair of ribbons are superimposed, have extended therebetween a drawstring. The drawstring is slidably mounted to the assembly and restrained at a longitudinal spaced positions along the superimposed ribbons by retaining means which encircles or otherwise captures the drawstring between the ribbon members. The arrangement is facilitated by cutouts within opposite side edges of the ribbons thus maintain the drawstring aligned with the longitudinal axis of the pair of ribbons functioning as a principal component of the ribbon assembly. The retainers employed U.S. Pat. No. 4,585,676, are in the form of endless bands or rings which are prevented from moving on the assembly since they also engage the edges of the cutouts from opposite side edges of the pair of ribbon members.

In recent years, attempts have been made to ensure that when the drawstring is pulled, the ribbon formed loops fan out rather than being aligned in a one vertical plane as a stack thus frustrating the user's desire to have the bow in rosette or pom-pom form. Manual shifting or rotation of the loops folded onto themselves is not only time consuming, but the loops tend to become torn or soiled.

U.S. Pat. No. 4,515,837 issued May 7, 1985 to Peter S. Cheng entitled Ribbon for Forming a Decorative Bow, employs cutouts formed within a pair of ribbon members which extend from opposite side edges towards the center line or axis of the ribbon members but which terminate short thereof. The notches or cutouts are longitudinal offset such that obliquely, narrow portions of the ribbon or necks which are defined by the notches, support the rings, loops or other retainer members at some angle with respect to the transverse direction across the notches with the retainer members of adjacent notches in the longitudinal direction of the ribbon assembly being inclined opposite to each other. With this arrangement, as the bow is formed and the loops created by pulling on the drawstring, the retainer members tend to seat automatically the bow loops in angular skewed orientation so that the loops of the bow are fanned out in an angular space rosette or pom-pom configuration.

In U.S. Pat. No. 4,656,064 issued Apr. 7, 1987 to Peter S. Cheng, entitled Decorative Bow-Forming Ribbon Assembly the notches are also longitudinally offset with the respect to each other for the ribbon or folded dual ribbon member assembly. In this case, the retainer members are eliminated, however there are created by notches extending from opposite side edges of the ribbon members toward the center, and longitudinally offset, bending zones spaced apart at intervals lengthwise of the ribbon and extending generally transversely across the ribbon and at angles of inclination relative to the central longitudinal axis. The inclinations of alternative binding zones are of opposite slope. Further, the bow-forming ribbon assembly utilizes a plurality of pairs of apertures, one pair at each binding zone, and situated on opposite sides of the longitudinal axis and offset in opposite transverse directions with respect to the bending zones. The longitudinal extending drawstring runs freely through those apertures, extending in a generally perpendicular direction between each pair of apertures. The result of this, is to ensure that by pulling the drawstring, uniform loops are formed in the ribbon members but with the loops distributed at various angles around the axis of the bow to give a pompom like shape to the bow.

While such arrangements as exemplified by U.S. Pat. Nos. 4,515,837 and 4,656,064 and have been successful in ensuring the formation of bows in which the successive loops are radiated relative to each other in a fan shape, such arrangements are complex, and increase the cost of production of the bow forming ribbon assemblies.

It is therefore a primary object of this invention to provide a bow forming ribbon assembly of at least one longitudinally extending decorative flexible ribbon having a plurality of cutouts in opposite side edges of said ribbon at longitudinally spaced positions forming narrow necks joining uncut portions of the ribbon intermediate of the cutouts and having a longitudinally extending drawstring fixed at one end to the longitudinally extending ribbon extending over the major length of the ribbon the drawstring, enveloped by a retainer circling each neck and asymmetrically locating the narrow necks relative to the longitudinal axis of at least one ribbon to thereby ensure that individual loops formed by the uncut portions of the ribbon intermediate of the cutouts are, automatically spaced angularly around the axis of the bow.

SUMMARY OF THE INVENTION

The present invention provides a bow forming ribbon assembly comprised of a longitudinally extending decorative flexible ribbon having opposite side edges and a central longitudinal axis. A plurality of cutouts are provided within opposite side edges of at least one ribbon at longitudinally spaced positions thereby forming narrow necks joining uncut portions of the ribbons intermediate of the cutouts. A longitudinally extending drawstring is fixed at an end of the longitudinally extending decorative flexible ribbon. The drawstring extends along the ribbon with retainers encircling each neck and the drawstring maintains the drawstring aligned with the necks whereby; pulling the free end of the drawstring causes loops to be formed within the uncut portions of the ribbon stacked upon each other separated by the retainers.

The invention is directed to an improvement wherein cutouts extend from said opposite side edges laterally beyond the longitudinal center line, alternating from side edge to side edge, such that longitudinally adjacent narrow necks are asymmetrically located to opposite sides of the longitudinal axis to ensure fanning out the loops in the formation of the bow.

A single cutout may be provided within one side edge of the ribbon at each longitudinally spaced position, alternating from side edge to side edge, over the length of the bow forming ribbon assembly.

Alternatively, cutouts may be provided within both side edges at each longitudinally spaced position, with the cutout from one side edge extending laterally beyond the longitudinal axis of the flexible ribbon while the other cutout within the opposite side edge, extends towards, but terminates short of the one cutout at the same longitudinally spaced position and in also short of the longitudinal axis.

The cutouts may be rectangular form, circular form or elongated elliptical curve form. The ribbon may be folded about a transverse fold line to form two ribbon members in face-to-face relationship with the drawstring situated between the ribbon members over a major portion of the length of the drawstring. Additionally, the drawstring itself may be folded in half to form two drawstring members extending from an attachment point on the decorative flexible ribbon with both drawstring members running freely through the retainers at the necks joining uncut portions of the ribbon, intermediate of the cutouts.

BRIEF DESCRIPTION OF THE DRAWINGS

FIG. 1 is a perspective view of a portion of a bow-forming ribbon assembly forming a preferred embodiment of the invention.

FIG. 2 is a side elevational view of a portion of the bow-forming assembly of FIG. 1.

FIG. 3 is a plan view of a portion of a longitudinal extending decorative flexible ribbon forming a further embodiment of the present invention.

FIG. 4 is a plan view of a portion of a longitudinal-extending decorative flexible ribbon forming yet a further embodiment of the present invention.

FIG. 5 is a perspective view of a complete bow formed by pulling of the drawstring members of the embodiment of the invention illustrated in FIGS. 1 and 2.

DESCRIPTION OF THE PREFERRED EMBODIMENTS

Referring to drawing FIGS. 1 and 2, a preferred embodiment of the invention is shown. The bow forming ribbon assembly indicated generally at 10 is comprised of longitudinally-extending, decorative, flexible ribbon members 14 and 16 formed from a ribbon indicated generally at 12. Members 14, 16 are linked or joined at their upper ends by a narrowed, considerably reduced portion of the ribbon indicated generally at 12. The junction take the form of a neck 28. Necks 28, other than that at the upper end, function to link the ribbon members 14, 16 together with an interposed drawstring 18 of narrow ribbon form. The drawstring 18 is tied as at 38 or otherwise fixed about the neck 28 which joins the upper ends of the ribbon members 14, 16, at ribbon fold line 40.

The two ribbon members 12, 14 are formed by taking a length of conventional decorative ribbon material and folding it at its middle about fold line 40. The drawstring 18 which may preferably be formed of very narrow width of the same material as members 14, 16, being tied at 38 to the narrow neck 28 linking upper uncut portions 30 of ribbon members 14, 16, passes between the face-to-face positioned ribbon members 14, 16.

In the illustrated embodiments of FIGS. 1 and 2, the drawstring 18 is a double length of such material which is tied at its middle about link 28 with the tie 38 being a simple overhand knot or the like.

Although in the embodiment of FIGS. 1 and 2, the ribbon 12 is formed from two ribbon members 14, 16 and there is employed a double length drawstring 18, a bow 10 such as may be formed by a single ribbon constituting a single length of the ribbon material as for instance half ribbon member 14 of the ribbon 12; and the drawstring may be constituted by a single length drawstring of narrow ribbon material tied or otherwise affixed to the top of the uppermost uncut portion 30 of the front ribbon member 14 of assembly 10.

The two ribbon members 14, 16 have in the illustrated embodiment of FIGS. 1 and 2, a pair of cutouts 24, 26 extending inwardly, alternatively from side edges 41, 42 respectively, of both ribbon members 14 and 16 at succeeding uniform longitudinally spaced positions. In such case, the cutouts 24 which are of rectangular form, extend inwardly past the vertical longitudinal axis 22 of ribbon members 14, 16, alternating from the left side edges 41 of respective members 14 and 16 to the right side edges 42 while, the shorter length rectangular cutouts 26 which extend laterally, inwardly are much shorter in length and terminate well short of the longitudinal axis 21.

The cutouts 24, 26 are asymmetrical and the long and short cutouts 24, 26 respectively alternates from side to side in succeeding fashion from the top of the ribbon assembly 10 to the bottom. As a result, the remaining very narrow portions of ribbon members 14 and 16 constituting necks 28, are asymmetrically offset to the right and left sides of the longitudinal axis 21 throughout the assembly 10. In the illustrated embodiment of FIGS. 1 and 2, and for alternative embodiments utilizing longitudinal extending decorative flexible ribbons 12' and 12'', long cutouts alternate from side to side at the longitudinally spaced positions over the length of the ribbons. Much in the fashion of cited references U.S. Pat. Nos. 4,585,676 and 3,954,212, ring members or like retainers 32 are employed encircling the aligned necks 28 for ribbon members 14, 16 and simultaneously encircling the drawstring 18 sandwiched therebetween at the spaced longitudinal position over the length of assembly 10 bearing the cutouts within ribbon members 14, 16. In the embodiment of FIGS. 1 and 2, the retainers 32 which are of oval ring form, may be formed of a thin transparent or translucent plastic, each retainer 32 including a radial slit at 34 so that the portions may be oppositely flexed at the slit to form a gap between opposing portions of the retainer 32 to permit the retainers to encircle the necks 28 of respective ribbon members 14 and 16 and the drawstring 18 passing therebetween.

As mentioned previously, in the embodiment of FIGS. 1 and 2, the drawstring 18 is folded over, transversely, at its center so that a pair drawstring members 20, 22 extend parallel to each other, obliquely throughout the respective full width ribbon segments 30 and crossing, in each instance case, the longitudinal axis 22 of the assembly and being held by the retainers 32 alternatively to opposite sides of the center line or longitudinal axis 22 of the assembly ribbon members 14, 16. Much of the description to this point, has correspondence within U.S. Pat. Nos. 3,637,455, 3,954,212 and 4,585,676 with the exception of the alternating lateral offsetting of the necks 28 to the right and left of the longitudinal axis 22 of ribbon members 14 and 16 to create an asymmetric arrangement of the connections between succeeding uncut portions 30 of ribbon members 14 and 16 of the assembly 10. In this invention the necks 28 joining the uncut ribbon portions 31 are oriented parallel to the longitudinal axis 22 of the ribbon members 14 and 16 and thus coincidence with the longitudinal axis of assembly 10 and, the retainers 32 are maintained essentially at right angles to that longitudinal axis.

The retainers 32 of ring form are sized so that the drawstring members 20, 22 slide freely through the retainers 32 and the diameter of the apertures or openings 36 within the retainer are in excess of the lateral widths of the necks 28 and the drawstring members 20, 22. Preferably, the width of the necks and the drawstring members 20 and 22 are equal. The retainers 32 are formed of thin plastic or other sheet material which is relatively stiff compared to ribbon members 14, 16. The relationship between the parts seen in FIG. 1 is enhanced by the side elevational view of a portion of that assembly 10 as per FIG. 2.

In operation, by pulling of the free ends of the drawstring members 20, 22 downwardly in a direction of arrow 42, FIG. 1, the uncut ribbon portions 30 are flexed outwardly and away from ribbon members 14, 16 and away from each other to form loops as illustrated in FIG. 2. The result of this action cause the retainers 32 to stack up upon each other in the formation of loops as at 44, FIG. 5, with free ends 14*a*, 16*a* extending downwardly from the area of stacking of retainers 32. During this time, the loops tend to rotate alternatively away from each other circumferentially about the stack of retainers 32, and about the longitudinal axis 22 of the assembly 10. Thus, successive loops 44 are skewed angularly relative to one another at different angles around the longitudinal axis 22 of the assembly, thereby creating a pompom type bow as indicated generally at 50 FIG. 5.

Once the bow 50 is formed, the drawstring members 20, 22 may be knotted for maintaining the stack of retainers 32 closely positioned along the longitudinal axis 22 of the assembly on the under side of the completed bow 50. The free ends of the drawstrings members 20, 22 may be cutoff or used for tying the bow to the exterior of a parcel or package thus employed for securing the completed bow in a position as a decorative ornament to the package.

Turning to FIG. 3, short and long length cutouts of partially arcuate form are provided within ribbon member 14' of ribbon 12' with the lateral width of cutouts 24', 26' being from respective edges 41, 42 short of and beyond the vertical axis 22 of ribbon 12' in that embodiment. Of course, from the same side edge 41 the succeeding transverse cutout at the next longitudinally spaced position from the first pair of cutouts 24, 12', 26' is a long cutout 26' while that cutout 26' inwardly of the right side edge 42 of ribbon number 14', is a short length cutout. The result of this is to have the neck 28' proximate to the fold 40 of the folded over ribbon 12', being to the left of the vertical axis 22, while at the second, succeeding longitudinally spaced position, that neck 28' is to the right of the longitudinal axis 22. Again, the asymmetric alternation of the necks 28' back and forth across the longitudinal axis 22' and centerline of ribbon 12' ensures during bow forming, as per FIG. 5, an automatic rotation of the loops as in 44 formed by the uncut portions 30' of ribbon 12' that about longitudinal axis. In all respects, using ribbon 12' for ribbon 12, a bow forming ribbon assembly is formed utilizing a folded, double length drawstring such as in 18 formed of drawstring members 20, 22 and utilizing the ring form retainers of plastic sheet as per 32 as a modification of the embodiment of FIGS. 1 and 2.

Referring next to FIG. 4, a further embodiment of the invention utilizes, solely alternating side edge rectangular plan shape cutouts 24'' which in this case constitute single cutouts at each of the longitudinal spaced positions over the length of the bow forming ribbon 12''. Ribbon 12' is also folded over to form an outer or front ribbon number 14'' with a mirror image rear member (not shown) immediately behind the same and in face-to-face position. Other than that change for this assembly, the cutouts are all long length cutouts as at 24'' which alternately extend laterally inwardly from left side edge 40 and right side edge 42 of the ribbon member 12'' (and indeed both within the front ribbon member 14'' and the folded over ribbon member not shown). As may be apparent, the utilization of the single cutouts from alternating side edges of the ribbon 12'' whether as a single ribbon or folded dual ribbon members extending the longitudinal axis 22, creates an asymmetrical positioning of longitudinally adjacent necks 28'' of ribbon 12' to the left and right of the longitudinal axis 22. Upon incorporating the ribbon 12' in the assembly 10 of FIGS. 1 and 2, for ribbon 12, therein and by the utilization of the folded over drawstring 18 and a retainer 32 at each neck 28'' location there is created a equivalent bow forming ribbon assembly to that at 10 in FIG. 1 which operates under the same principles to produce a bow essentially identical to that at 50 in FIG. 5, during pulling of drawstring 18.

Although the invention has been described in considerable detail in the foregoing four purposes of illustration, with respect to multiple embodiments is to be understood that such detail is solely for this purpose, and that variations can be made therein skilled in the art without departing from the spirit and scope of the invention, except as set forth in the following claims.

I claim:

1. In a bow-forming ribbon assembly comprising:

a longitudinal-extending decorative flexible ribbon having opposite side edges and a central longitudinal axis;

a plurality of cutouts within opposite side edges of said ribbon at longitudinally spaced positions forming narrow necks joining uncut portions of said ribbon intermediate of said cut-outs;

a longitudinally extending drawstring fixed at one end to said longitudinally extending decorative flexible ribbon and extending along said ribbon; and a retainer encircling each neck and said drawstring at said neck, such that said drawstring runs freely through said retainer, whereby; pulling of the free end of the drawstring causes loops to be formed by said uncut portions of said ribbon within said assembly by stacking of the retainers in proximity to each other, the improvement wherein;

said cutouts extend from said opposite side edges laterally beyond the longitudinally center line such that necks alternate asymmetrically to opposite sides of the longitudinal center line such that said loops, are automatically spaced angularly around the longitudinally axis of the bow-forming ribbon assembly during the formation of the bow.

2. The bow-forming ribbon assembly as claimed in claim 1, wherein the ribbon is folded about a transverse fold axis to form two ribbon members in face-to-face relationship; and wherein the drawstring is situated between the ribbon members over a major portion of the length of the drawstring and crosses alternatively in opposite oblique directions within the uncut portions of said ribbon member intermediate the longitudinally spaced cutouts.

3. The bow-forming ribbon assembly as claimed in claim 2, wherein the drawstring is folded to form two drawstring members, one drawstring member for each ribbon member and each drawstring member runs freely through retainers between superimposed necks of respective ribbon members at each of said longitudinally spaced positions.

4. The bow-forming ribbon assembly as claimed in claim 1, wherein a single lateral cutout is provided within a side edge of said ribbon at each longitudinally spaced position and said cutouts alternate within said opposite side edges at adjacent longitudinally spaced positions.

5. The bow-forming ribbon assembly as claimed in claim 2, wherein a single lateral cutout is provided within a side edge of said ribbon at each longitudinally spaced position and said cutouts alternate within said opposite side edges at adjacent longitudinally spaced positions.

6. The bow-forming ribbon assembly as claimed in claim 3, wherein a single lateral cutout is provided within a side edge of said ribbon at each longitudinally spaced position and said cutouts alternate within said opposite side edges at adjacent longitudinally spaced positions.

7. The bow-forming ribbon assembly as claimed in claim 1, wherein lateral cutouts are provided within opposite side edges of said ribbon at each longitudinally spaced position, including long length cutouts within opposite side edges of said ribbon at adjacent longitudinally spaced positions, which long length cutouts extend laterally beyond the central longitudinal axis, and short length cutouts within the opposite side edge of said ribbon at each longitudinally spaced position which are of a lateral length such that they extend towards but terminate short of said central longitudinal axis, whereby said narrow necks are located inwardly of the opposite side edges of said ribbon.

8. The bow-forming ribbon assembly as claimed in claim 2, wherein lateral cutouts are provided within opposite side edges of said ribbon at each longitudinally spaced position including long length cutouts within opposite side edges of said ribbon at adjacent longitudinally spaced positions, which long length cutouts extend laterally beyond the longitudinal axis and, short length cutouts within the opposite side edge of said ribbon, at each longitudinally spaced position, which are of a lateral length such that they extend towards but terminate short of said longitudinal axis, whereby said narrow necks are located inwardly of the opposite side edges of said ribbon.

9. The bow-forming ribbon assembly as claimed in claim 3, wherein lateral cutouts are provided within opposite side edges of said ribbon at each longitudinally spaced position including long length cutouts within opposite side edges of said ribbon at adjacent longitudinally spaced positions, which long length cutouts extend laterally beyond the longitudinal axis and, short length cutouts within the opposite side edge of said ribbon at each longitudinally spaced position, which are of a lateral length such that they extend towards but terminate short of said longitudinal axis, whereby said narrow necks are located inwardly of the opposite side edges of said ribbon.

10. The bow-forming ribbon assembly as claimed in claim 1, wherein said lateral cutouts are of rectangular plan configuration.

11. The bow-forming ribbon assembly as claimed in claim 1, wherein said lateral cutouts are at least partially of arcuate plan configuration.

12. The bow-forming ribbon assembly as claimed in claim 1, wherein said lateral cutouts are of at least partially o circular plan configuration.

13. The bow-forming ribbon assembly as claimed in claim wherein the width of said drawstring is generally equal to the width of said neck interposed between the uncut portions of said ribbon.

14. The bow-forming ribbon assembly as claimed in claim 1, wherein said retainers are of thin, flexible plastic sheet material and are of ring form and include radial slits permitting portions to opposite sides of the slit to be flexed relative to each other for faciliatating assembly of a retainer circling each neck and said drawstring at each of said longitudinally spaced positions.

* * * * *

UNITED STATES PATENT AND TRADEMARK OFFICE

CERTIFICATE OF CORRECTION

PATENT NO. : 5,114,761

DATED : May 19, 1992

INVENTOR(S) : Henry T. DOHERTY

It is certified that error appears in the above-identified patent and that said Letters Patent is hereby corrected as shown below:

Column 8, line 50, delete "o", and insert --of--;

Column 8, line 52, after "claim", insert --1--;

Column 8, line 59, delete "faciliatating", and insert --facilitating--.

Signed and Sealed this

Thirty-first Day of August, 1993

Bruce Lehman

*Attest:*

BRUCE LEHMAN

*Attesting Officer*

*Commissioner of Patents and Trademarks*